US006106312A

United States Patent [19]

Iwahori

[11] Patent Number: 6,106,312

[45] Date of Patent: Aug. 22, 2000

[54] LOW INSERTION FORCE CONNECTOR ASSEMBLY

[75] Inventor: Yoshihiro Iwahori, Shizuoka, Japan

[73] Assignee: Yazaki Corporation, Tokyo, Japan

[21] Appl. No.: 09/041,049

[22] Filed: Mar. 12, 1998

[30] Foreign Application Priority Data

Mar. 14, 1997 [JP] Japan ..... 9-060673

[51] Int. Cl.[7] ..... H01R 13/62

[52] U.S. Cl. ..... 439/157

[58] Field of Search ..... 439/157, 347, 439/310, 159, 160

[56] References Cited

U.S. PATENT DOCUMENTS

| | | | |
|---|---|---|---|
| 4,875,873 | 10/1989 | Ishizuka | 439/347 |
| 5,183,408 | 2/1993 | Hatagishi . | |
| 5,344,194 | 9/1994 | Hattagishi et al. | 439/310 |
| 5,482,394 | 1/1996 | Shinchi et al. | 439/157 |
| 5,618,195 | 4/1997 | Cappe et al. | 439/157 |
| 5,876,226 | 3/1999 | Tsukakoshi et al. | 439/157 |
| 5,888,080 | 3/1999 | Maejima | 439/157 |

FOREIGN PATENT DOCUMENTS

| | | | |
|---|---|---|---|
| 0459448 | 5/1991 | European Pat. Off. . | |
| 4-319271 | 11/1992 | Japan | H01R 13/629 |
| 6-52929 | 2/1994 | Japan | H01R 13/629 |

OTHER PUBLICATIONS

Patent Abstracts of Japan, vol. 17, No. 152, Nov. 10, 1992.

*Primary Examiner*—Steven L. Stephan
*Assistant Examiner*—J. F. Duverne
*Attorney, Agent, or Firm*—Sughrue, Mion, Zinn, Macpeak & Seas, PLLC

[57] ABSTRACT

In a low insertion force connector assembly in which cam pins protruded from upper and lower walls of a housing of a male connector are guided by cam grooves formed in upper and lower walls of a slider which are confronted with each other, so that the male connector is inserted into a female connector, the cam pins are provided in the housing of the male connector in such a manner that the cam pins are popped in and out of the housing freely and elastically.

6 Claims, 3 Drawing Sheets

LOW INSERTION FORCE CONNECTOR ASSEMBLY

BACKGROUND OF THE INVENTION

1. Field of the Invention

This invention relates to a low insertion force connector assembly which has a slider to connect male and female connectors to each other with a low insertion force, and more particularly to a low insertion force connector assembly in which a cam pin protruded from the housing side wall of a male connector is positively protected from external force.

2. Description of the Related Art

A multi-pole connector has a number of terminals, and therefore it is necessary to apply a great force to connect male and female connectors to each others; that is, it is rather difficult to connect them to each other and to disconnect them from each other. In view of the foregoing, a number of kinds of low insertion force connector assemblies have been proposed in the art which have low insertion force (LIF) mechanisms.

In a typical example of those low insertion force connector assemblies, a slider is operated to perform the connection or disconnection thereof.

A conventional low insertion force connector assembly of this type has been disclosed, for instance, in Japanese Patent Unexamined Publication No. Hei. 4-319271. FIG. 3 is an exploded perspective view of the conventional low insertion force connector assembly.

The low insertion force connector assembly comprises: male connectors 111 and 112 each of which has a number of female terminal; a rectangular-frame-shaped holder 120 which accommodates the male connectors 111 and 112; a female connector 130 into which the male connectors 111 and 112 accommodated in the holder 120 are inserted; and a slider 140 which is used to achieve the connection and disconnection of the male connectors 111 and 112 and the female connector 130.

Four cam pins 121, 121, 121 and 121 are protruded from the upper and lower walls of the holder 120, and slider insertion holes 131, 131, 131 and 131 are formed in both (right and left) side walls of the female connector 130, and cam grooves 141, 141, 141 and 141 are formed in the upper and lower walls of the slider 140 in such a manner that they are engaged with the cam pins 121, 121, 121 and 121 of the holder 120, respectively.

In the low insertion force connector assembly thus constructed, the slider 140 is inserted into the female connector 130 to a predetermined position (depth), and the cam grooves 141 of the slider 140 and the cam pins 121 of the holder 120 are positioned.

When, under this condition, the slide 140 is further inserted into the female connector 130, the cam pins 121 of the holder 120 are guided by the cam grooves 141 of the slider 140, respectively, so that the male connectors 111 and 112 accommodated in the holder 120 are inserted into the female connector 130.

As is apparent from the above description, with the low insertion force connector assembly, the insertion of the slider 140 makes it possible to insert the male connectors 111 and 112 into the female connector 130 with low force.

In contrast, when it is required to disconnect the male connectors 111 and 112 from the female connector 130, the slider 140 is pulled out of the female connector 130.

The above-described conventional low insertion force connector assembly suffers from the following difficulties:

The small cam pins 121 and the upper and lower walls of the hole 120 are formed as one unit by molding synthetic resin. Hence, during transportation of the manufactured low insertion force connector assembly, the cam pins 121 may be crushed or bent by external force.

SUMMARY OF THE INVENTION

In view of the foregoing, an object of the invention is to provide a low insertion force connector assembly which is simple in construction and positively protects the cam pins from being bent or broken.

In order to achieve the foregoing object, the invention provides a low insertion force connector assembly in which cam pins protruded from upper and lower walls of a housing of a male connector are guided by cam grooves formed in upper and lower walls of a slider which are confronted with each other, so that the male connector is inserted into a female connector, wherein the cam pins are provided in the housing of the male connector in such a manner that the cam pins are popped in and out of the housing freely and elastically.

Further, the invention provides a low insertion force connector assembly in which cam pins protruded from upper and lower walls of a housing of a male connector are guided by cam grooves formed in upper and lower walls of a slider which are confronted with each other, so that the male connector is inserted into a female connector, the connector assembly comprising: cam pins each of which comprises a cylindrical body, and a flange extended from a bottom of the cylindrical body; accommodating grooves which are formed in the upper and lower walls of the housing of the male connector, each of the accommodating grooves being open at one end thereof, with the other end thereof provided as a semi-circular receiving portion which is equal in external form to each of the cam pins; elastic members which elastically support the cam pins which are accommodated in the accommodating grooves; and stoppers each of which has a semi-circular receiving portion which is equal in external form to each of the cam pins, the stoppers being fitted in open ends of the accommodating grooves to hold the cam pins in the accommodating grooves.

BRIEF DESCRIPTION OF THE DRAWINGS

FIG. 1(*b*) is a perspective view of the male connector which has been assembled.

DETAILED DESCRIPTION OF THE PREFERRED EMBODIMENT

A low insertion force connector assembly, which constitutes an embodiment of this invention, will be described with the accompanying drawings.

Figure 1A:
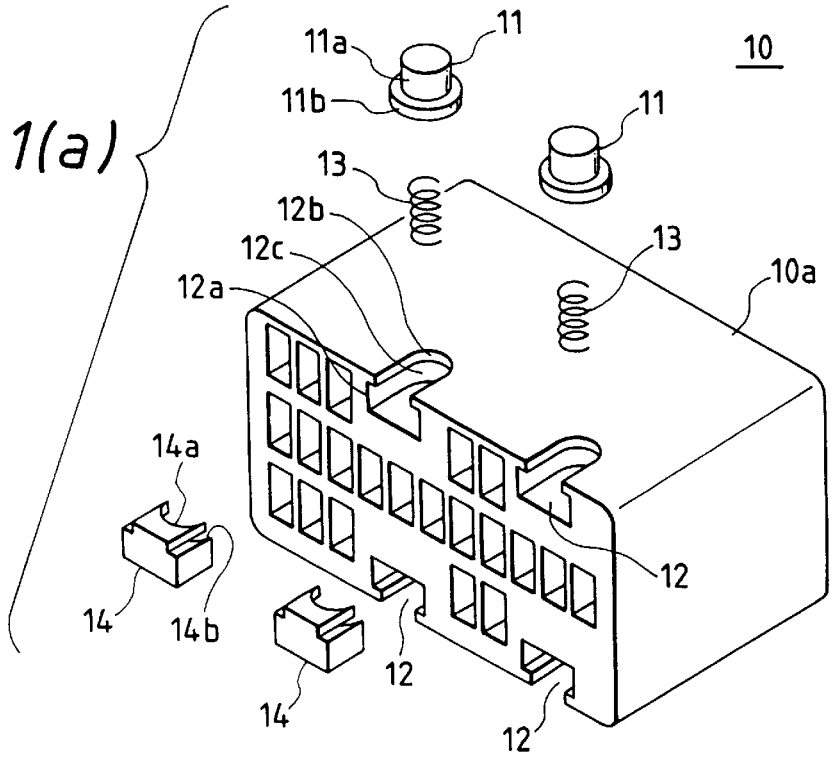
FIG. 1(*a*) is an exploded perspective view of a male connector forming a low insertion force connector assembly which constitutes an embodiment of the invention.
Figure 1B:
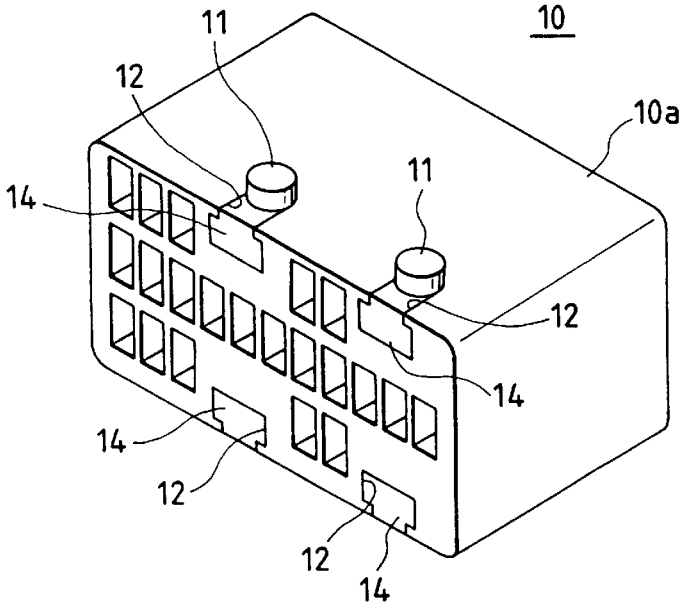

FIG. 1(*a*) is an exploded perspective view of a male connector which is a part of the low insertion force connector assembly according to the invention, and FIG. 1(*b*) is a perspective view of the male connector which has been assembled.

A specific feature of the low insertion force connector assembly of the invention resides in the arrangement of cam pins of the male connector. The assembly has a female connector, and a slider which are equal in design to those of the above-described conventional low insertion force connector assembly. Hence, hereinafter, mainly, only the male connector (the specific feature of the invention) will be described.

In FIGS. 1(*a*) and 1(*b*), reference numeral 10 designates the male connector. The male connector 10 has a housing 10*a* whose upper and lower walls have cam pins 11, 11, 11 and 11.

Each of the cam pins 11 comprises: a cylindrical body 11*a*; and a disk-shaped flange 11*b* extended from the bottom of the cylindrical body 11*a*. The cam pins 11 are elastically fitted in accommodating grooves 12 formed in the upper and lower walls of the housing 10*a* through springs 13, respectively.

Each of the accommodating grooves 12 is a groove inverted-T-shaped in section which has two widths in correspondence to the body 11*a* and the flange 11*b* of the cam pin 11, and has an opening 12*a* at one end. The other end of each of the accommodating grooves is formed into semi-circular receiving portions 12*b* and 12*c* which corresponds to the external forms of the body 11*a* and the flange 11*b* of the cam pin 11.

Reference numeral 14 designates stoppers. Each of the stoppers 14 is equal in external form to the section of the accommodating groove 12, and is fitted in the groove 12 to hold the cam pin 11 therein.

Similarly as in the receiving portions 12*b* and 12*c* of each of the accommodating grooves 12, the front end portion of each of the stoppers 14 is formed into semi-circular receiving portions 14*a* and 14*b* which correspond in external form to the body 11*a* and the flange 11*b* of the cam pin 11.

Those receiving portions 14*a* and 14*b* are confronted with the receiving portions 12*b* and 12*c* of the accommodating groove 12 when the stopper 14 is fitted in the groove 12, thus forming a circular in-and-out hole which is substantially equal in diameter to the body 11*a* of the cam pin 11 and a slide space which is substantially equal in diameter to the flange 11*b* of the cam pin 11.

In the male connector thus constructed, the cam pins 11 are held protruded from the upper and lower walls of the housing 10*a* when no external force is applied thereto.

Figure 2:
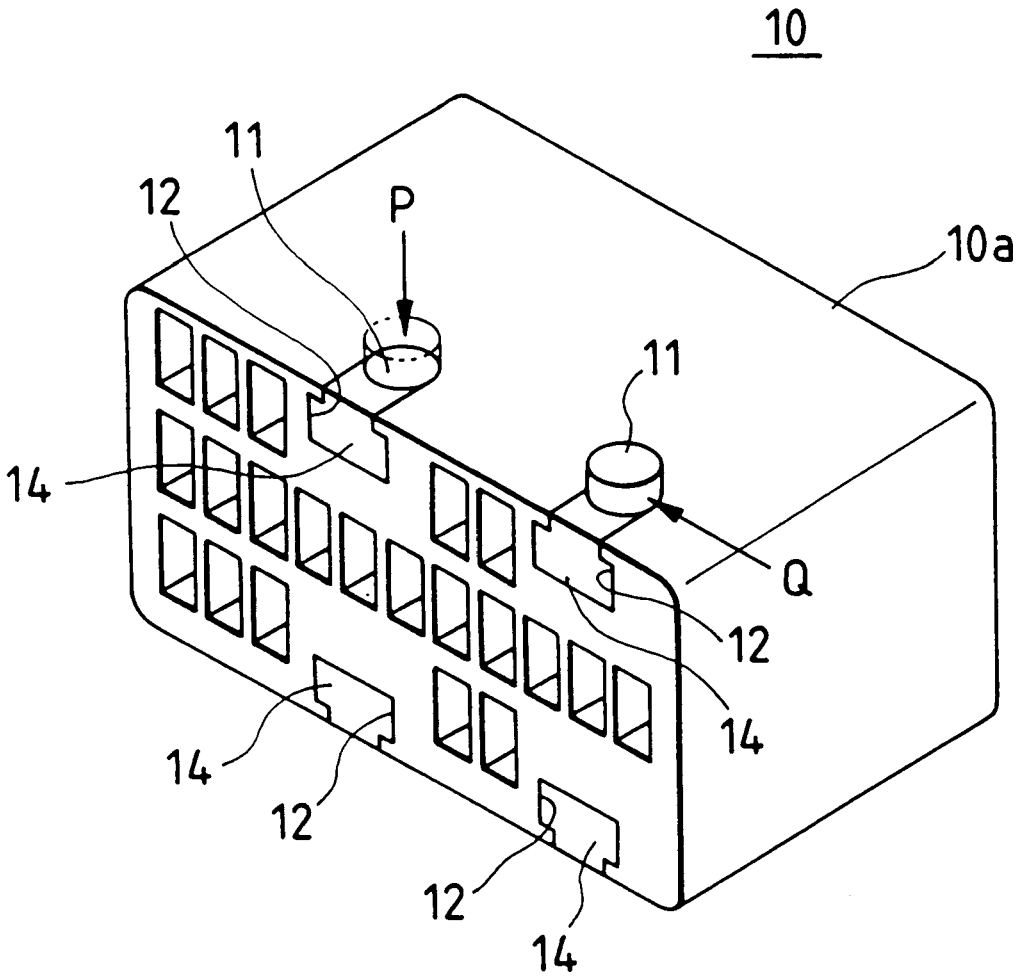
FIG. 2 is a perspective view for a description of the pop in-and-out operation of cam pins of the male connector.
Figure 3:
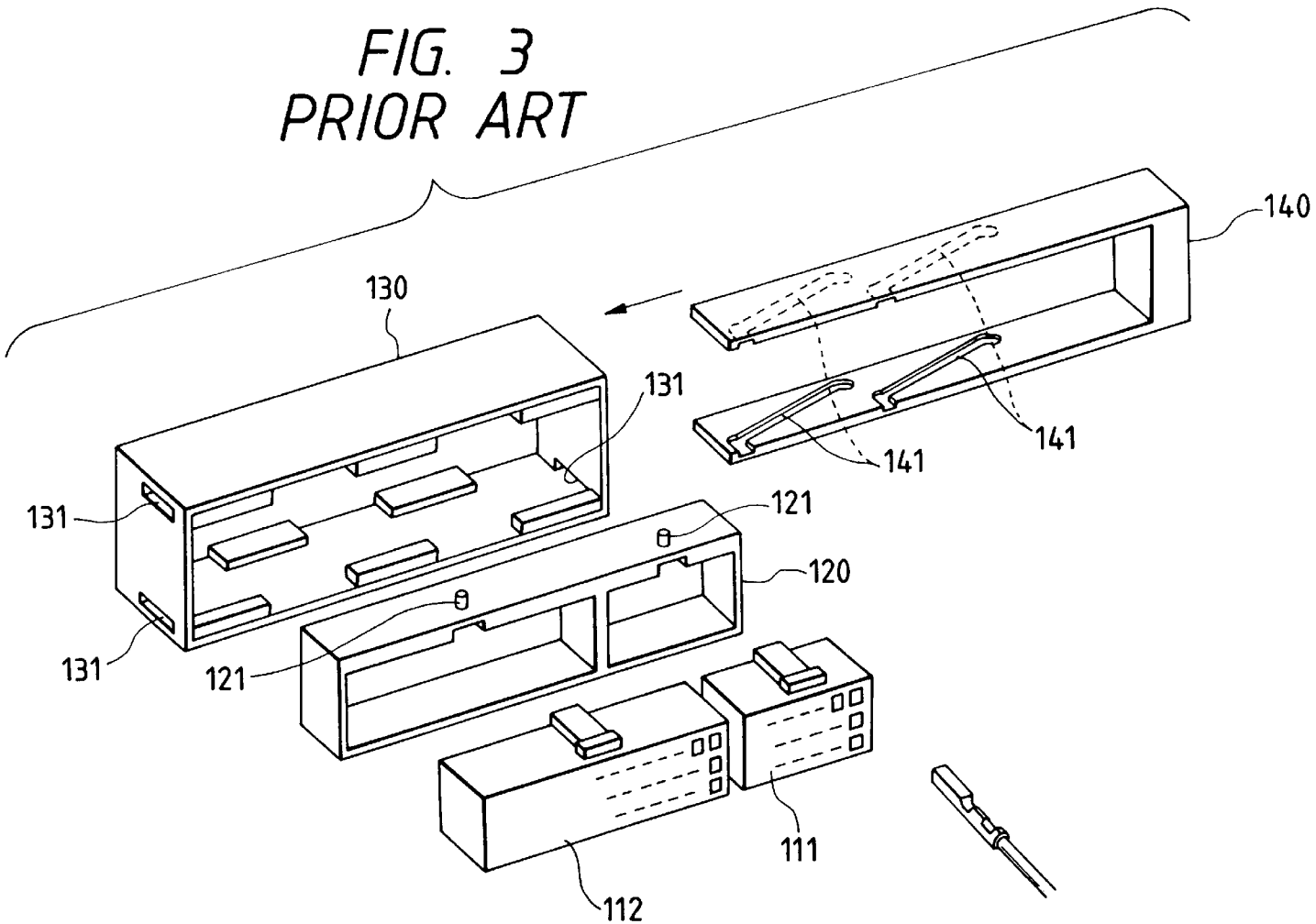
FIG. 3 PRIOR ART
FIG. 3 is an exploded perspective view of a conventional low insertion force connector assembly with a slider.

When, as shown in FIG. 2, external force P is vertically applied to each of the cam pins 11, the latter 11 is elastically sunk in the accommodating groove 12 with the aid of the elastic force of the spring 13. In this operation, the vertical external force P applied thereto is moderated.

Hence, the cam pins 11 are positively protected from the vertical external force P.

When, as shown in FIG. 2, external force Q is horizontally applied to each of the cam pins 11, the latter 11 is held protruded as it is. Hence, the male connector is free from the difficulty that the cam pins 11 are sunk in the walls of the housing 10*a* by the horizontal external force Q which is applied thereto when the cam pins 11 are being guided by the cam grooves. That is, the connection of the male and female connectors with each other can be smoothly achieved.

The low insertion force connector assembly has been described; however, the invention is not limited to the embodiment. For instance, the elastic elements supporting the cam pins 11 are not limited to the springs 13; that is, the springs 13 may be replaced with leaf springs or rubber members. In the case where, instead of the springs 13, the leaf springs are employed, the they may be integrated with the rear surfaces of the cam pins 11 when they are formed by molding synthetic resin.

As is apparent from the above description, the low insertion force connector assembly of the invention is simple in structure, and its cam pins are positively protected from external force which may be applied thereto during transportation of the connector assembly. Besides, the connection of the male and female connectors with the slider can be achieved smoothly.

What is claimed is:

1. A low insertion force connector assembly comprising:

a slider having a pair of opposed walls, said slider having a plurality of cam grooves formed in said pair of opposed walls respectively;

a male connector having a male housing with a pair of opposed walls, said pair of opposed walls having a plurality of cam pins respectively protruded therefrom corresponding to a protruded position, said cam pins being retractable into said housing to a retracted position and;

a female connector in which said slider is received, said cam pins being respectively received in said cam grooves of said slider to urge said male connector into said female connector.

2. A low insertion force connector assembly according to claim 1 further comprising: an elastic member urging said cam pin toward said protruded portion.

3. A low insertion force connector assembly according to claim 2 wherein said cam pins have a cylindrical body, and a flange extended from a bottom of said cylindrical body.

4. A low insertion force connector assembly according to claim 3 wherein said male housing has accommodating grooves formed in said pair of opposed walls respectively, each of said accommodating grooves being open at one end thereof, with the other end thereof provided as a semi-circular receiving portion which is equal in external form to each of said cam pins.

5. A low insertion force connector assembly according to claim 4 further comprising: Stoppers having semi-circular receiving portions which are equal in external form to each of said cam pins respectively, said stoppers being fitted in open ends of said accommodating grooves to hold said cam pins in said accommodating grooves respectively.

6. A low insertion force connector assembly according to claim 2 wherein said elastic member is a spring.

* * * * *